US008429785B1

(12) United States Patent
Royal

(10) Patent No.: US 8,429,785 B1
(45) Date of Patent: Apr. 30, 2013

(54) ERECTABLY OPERABLE HAND TROWEL

(76) Inventor: Michael Royal, North Wilkesboro, NC (US)

( * ) Notice: Subject to any disclaimer, the term of this patent is extended or adjusted under 35 U.S.C. 154(b) by 142 days.

(21) Appl. No.: 13/072,853

(22) Filed: Mar. 28, 2011

(51) Int. Cl.
*E04F 21/16* (2006.01)
*E01C 19/44* (2006.01)

(52) U.S. Cl.
USPC ..... 15/235.8; 15/144.1; 294/53.5; 404/118

(58) Field of Classification Search ..... 15/144.1, 15/235.4–235.8, 245.1; 294/53.5, 58; 404/97, 404/118; D8/45
See application file for complete search history.

(56) References Cited

U.S. PATENT DOCUMENTS 988,457 A * 4/1911 Glasscock ..... 15/235.8
3,090,984 A * 5/1963 Dunnigan ..... 15/235.4
4,723,869 A 2/1988 Dragich
4,982,470 A * 1/1991 Szabo ..... 15/245.1
D327,616 S 7/1992 Owens
5,319,825 A 6/1994 Fanning
6,622,453 B2 9/2003 Dove
7,396,187 B1 7/2008 Meyers
7,464,432 B2 12/2008 Goller

* cited by examiner

*Primary Examiner* — Mark Spisich
(74) *Attorney, Agent, or Firm* — Kyle Fletcher

(57) ABSTRACT

The erectably operable hand trowel is composed of an elongated handle that extends from a trowel head up to a handle that is engaged upon by an end user. The elongated handle includes an actuator handle that is pivotally engaged about the elongated handle and of which includes at least one pivot rod, which extends from the actuator handle down to the trowel head. The actuator handle provides for articulation of the trowel head about the bottom of the elongated handle, which enables the end user to adjust the angle of the trowel head when pulled across a surface being flattened or smoothed via the trowel head. The erectably operable hand trowel enables an end user to trowel a surface from an upright position.

11 Claims, 5 Drawing Sheets

ERECTABLY OPERABLE HAND TROWEL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of hand trowels, more specifically, a hand trowel that can be used while standing.

B. Discussion of the Prior Art

As a preliminary note, it should be stated that there is an ample amount of prior art that deals with hand trowels. As will be discussed immediately below, no prior art discloses a hand trowel that is operable by an end user from a fully erect position in which the hand trowel is made of an elongated handle that attaches to a trowel head; wherein an actuator handle is pivotally engaged upon the elongated handle and includes at least one pivot rod that extends down to the trowel head such that upon rotation of the actuator handle, the trowel head articulates about the end of the elongated handle; wherein an end user can articulate the trowel head when traversing a new section of wet concrete to insure proper performance of the trowel head thereon.

The Meyers Patent (U.S. Pat. No. 7,396,187) discloses a trowel that is to be used by an operator while in a generally upright orientation. However, the trowel does not articulate about an end of the handle via an actuator handle.

The Goller Patent (U.S. Pat. No. 7,464,432) discloses a Weighted trowel with an elongated handle. Again, the trowel does not have an actuator handle to articulate the trowel head about the handle.

The Fanning Patent (U.S. Pat. No. 5,319,825) discloses an extension for a concrete trowel. However, the extension is not integrated into the design of a trowel that can be operated by an end user in an upright position and of which does not include an actuator handle to articulate the trowel head thereon.

The Dragich Patent (U.S. Pat. No. 4,723,869) discloses a long handled trowel with adjustable weights. Again, the trowel is not articulated about the elongated handle in that there is no actuator handle to articulate the trowel head thereon.

The Dove Patent (U.S. Pat. No. 6,622,453) discloses a tooling and method for application of a textured ceiling and for removal of an accounstical ceiling. However, the tooling and method are not directed to use of a trowel head on a ground surface with an actuator handle for articulation thereon.

The Owens Patent (U.S. Pat. No. Des. 327,616) illustrates an ornamental design for a concrete smmother and placer tool, which fails to illustrate an actuator handle that would articulate the trowel head.

While the above-described devices fulfill their respective and particular objects and requirements, they do not describe a hand trowel that is operable by an end user from a fully erect position in which the hand trowel is made of an elongated handle that attaches to a trowel head; wherein an actuator handle is pivotally engaged upon the elongated handle and includes at least one pivot rod that extends down to the trowel head such that upon rotation of the actuator handle, the trowel head articulates about the end of the elongated handle; wherein an end user can articulate the trowel head when traversing a new section of wet concrete to insure proper performance of the trowel head thereon. In this regard, the hand trowel departs from the conventional concepts and designs of the prior art.

SUMMARY OF THE INVENTION

The erectably operable hand trowel is composed of an elongated handle that extends from a trowel head up to a handle that is engaged upon by an end user. The elongated handle includes an actuator handle that is pivotally engaged about the elongated handle and of which includes at least one pivot rod, which extends from the actuator handle down to the trowel head. The actuator handle provides for articulation of the trowel head about the bottom of the elongated handle, which enables the end user to adjust the angle of the trowel head when pulled across a surface being flattened or smoothed via the trowel head. The erectably operable hand trowel enables an end user to trowel a surface from an upright position.

An object of the invention is to provide a hand trowel that can be used by an end user in an upright position so as to prevent or require an end user from kneeling down in order to use a traditional hand trowel.

A further object of the invention is to provide an actuator handle that enables the trowel head to articulate about a bottom of the elongated handle such that as an end user draws the trowel head across a surface, the angle formed between the trowel head and the elongated handle is continuously adjusted to ensure a smooth transition across the surface being smoothed by the trowel head.

A further object of the invention is to provide an elongated handle that includes at least one pivot rod to translate the rotation of the actuator handle to the trowel head.

A further object of the invention is to provide an elongated handle that includes a grip at a top end, which is grabbed by an end user.

These together with additional objects, features and advantages of the hand trowel will be readily apparent to those of ordinary skill in the art upon reading the following detailed description of presently preferred, but nonetheless illustrative, embodiments of the hand trowel when taken in conjunction with the accompanying drawings.

In this respect, before explaining the current embodiments of the hand trowel in detail, it is to be understood that the hand trowel is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the hand trowel.

It is therefore important that the claims be regarded as including such equivalent construction insofar as they do not depart from the spirit and scope of the hand trowel. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
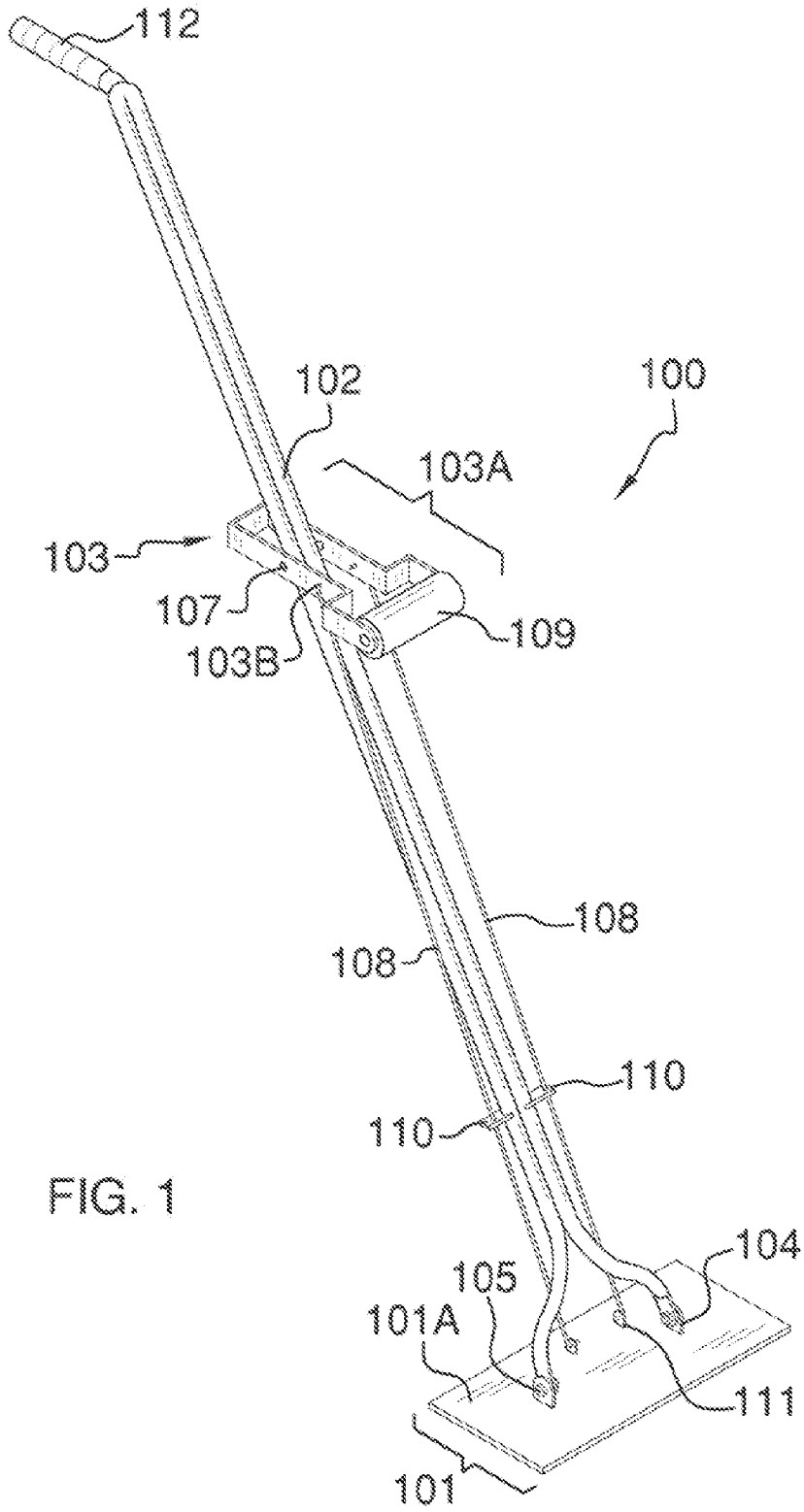
FIG. 1 illustrates a front, isometric view of the hand trowel.
Figure 2:
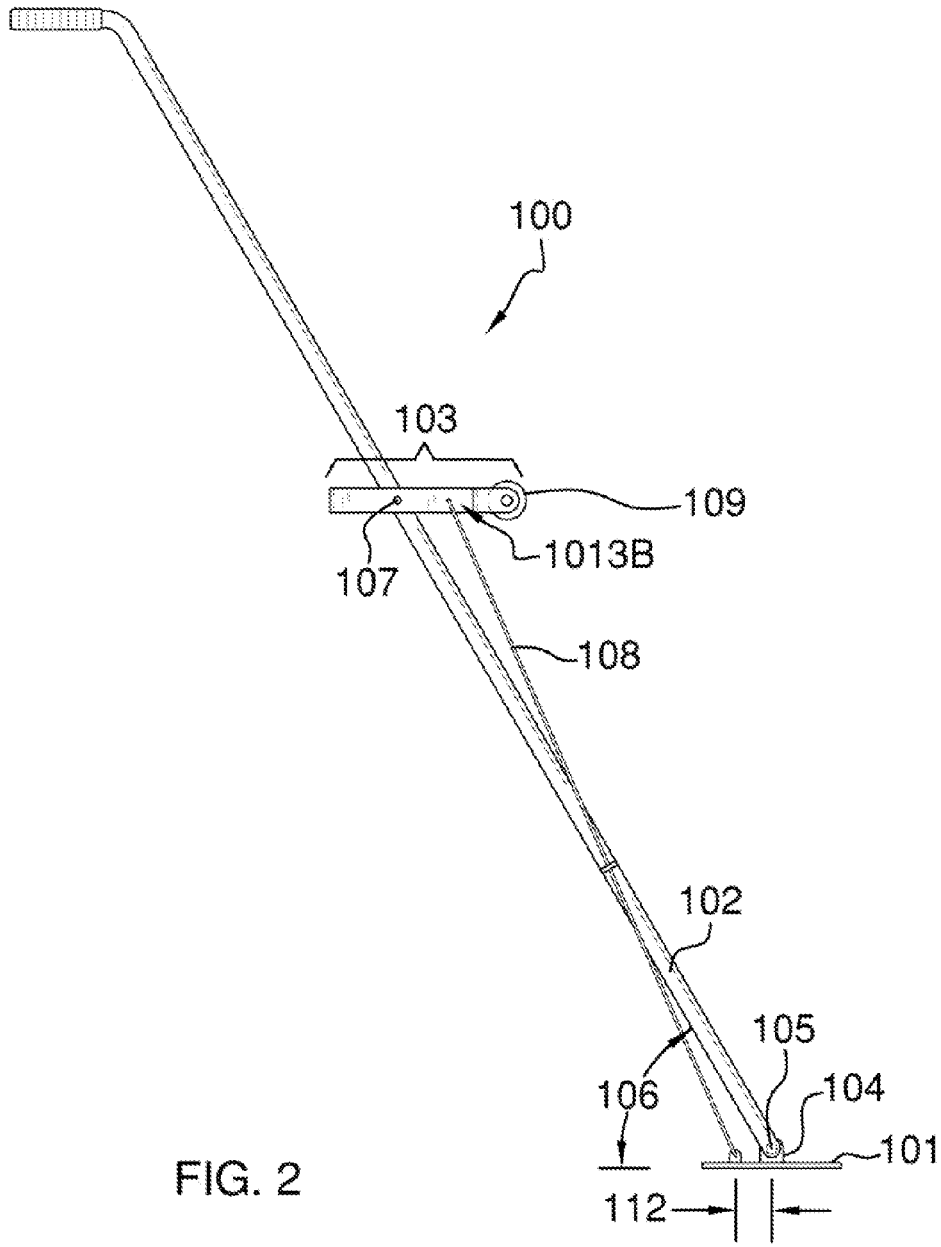
FIG. 2 illustrates a side view of the hand trowel by itself.
Figure 3:
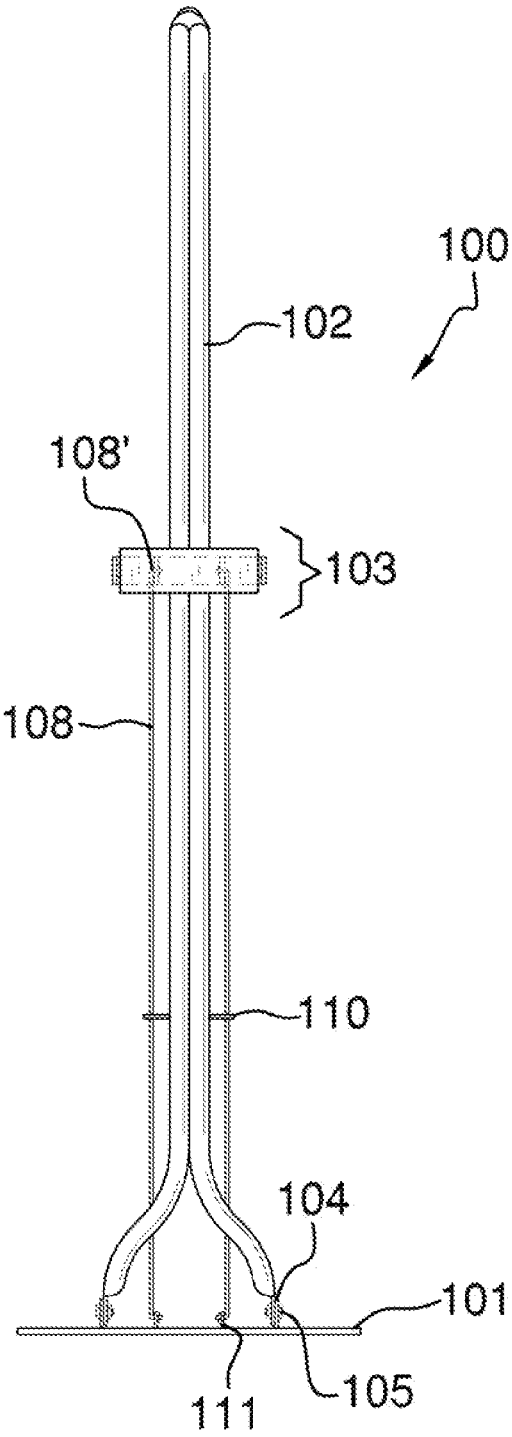
FIG. 3 illustrates a front view of the hand trowel by itself.
Figures 4A, 4B, 4C:
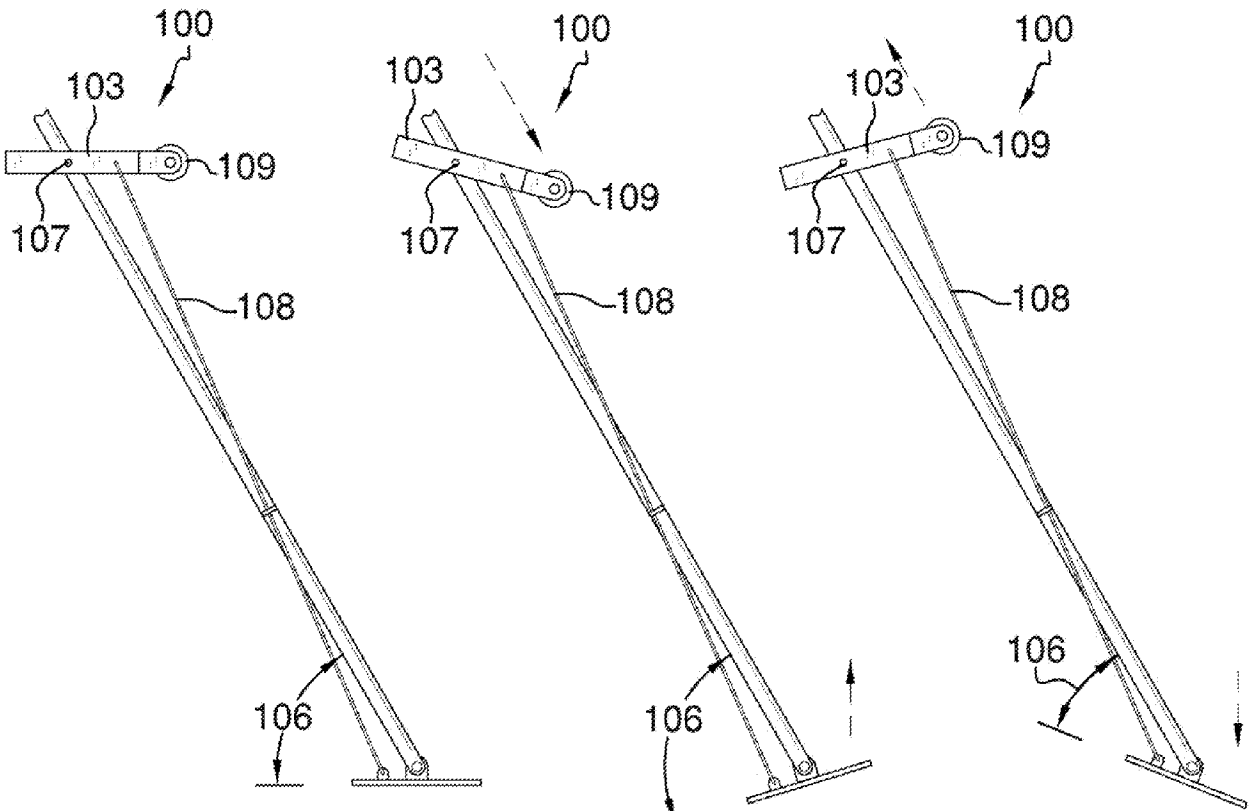
FIG. 4A illustrates a side view of the hand trowel in which the actuator handle is engaged at a middle orientation.
FIG. 4B illustrates a side view of the hand trowel in which the actuator handle is rotated downwardly as indicated by a downward arrow, and the trowel head is rotated upwardly as indicated by an upward arrow.
FIG. 4C illustrates a side view of the hand trowel in which the actuator handle is rotated upwardly as indicated by an upward arrow, and the trowel head is rotated downwardly as indicated by a downward arrow.
Figure 5:
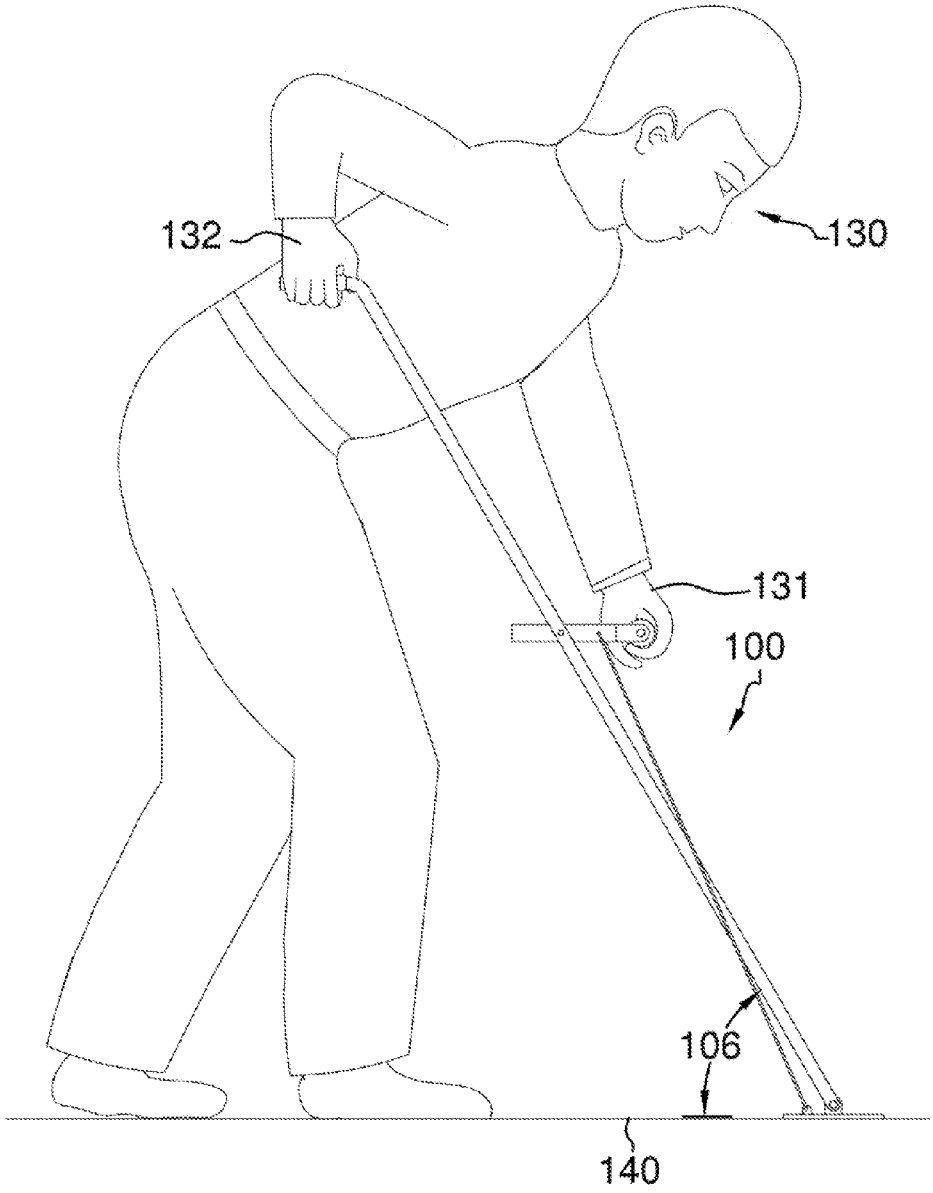
FIG. 5 illustrates a view of the hand trowel in use on a surface and being controlled by an end user.

Detailed reference will now be made to the preferred embodiment of the present invention, examples of which are illustrated in FIGS. 1-5. A hand trowel 100 (hereinafter invention) includes a trowel head 101, an elongated handle 102, and an actuator handle 103.

The trowel head 101 is a generally flat piece of material that is rectangularly shaped. Handle brackets 104 extend from a top surface 101A of the trowel head 101. The handle brackets 104 attach the elongated handle 102 onto the trowel head 101. A nut and bolt combo 105 is employed to make secure the connection between the elongated handle 102 and the trowel head 101. More importantly, the trowel head 101 can rotate with respect to the elongated handle 102. Even more importantly, an angle 106 is formed between the trowel head 101 and the elongated handle 102. The angle 106 is adjusted via the actuator handle 103.

The actuator handle 103 is attached onto the elongated handle 102 at a pivot point 107. The actuator handle 103 can rotate about the elongated handle 102 via the pivot point 107.

At least one pivot rod 108 attaches to and extends down from the actuator handle 103 to the trowel head 101.

The actuator handle 103 attaches to the elongated handle 102 at the pivot point 107, and is further defined by a "U"-shaped bracket 103A that includes a handle bar 109 at an end of the "U"-shaped bracket 103A. The handle bar 109 is to be grabbed upon by a first hand 131 of an end user 130.

The pivot rod(s) 108 attach onto the "U"-shaped bracket 103A at a pivot rod point 103B. The pivot rod point 103B is essentially a hole into which the pivot rod 108 engages. The pivot rod(s) 108 extend from the actuator handle 103 down to the trowel head 101. The elongated handle 102 includes a pivot rod guide 110 at a predetermined point. The pivot rod guide 110 is essentially a bracket that extends out from a side of the elongated handle 102 and includes a hole through which the pivot rod 108 passes through and in essence is bound by and guided via the pivot rod guide 110.

The pivot rod(s) 108 extend down to and engage the top surface 101A of the trowel head 101 at pivot brackets 111. The pivot brackets 111, like the handle brackets 104, extend vertically from the top surface 101A of the trowel head 101, and provide a place with which to connect and rotate the pivot rod(s) 108 with respect to the trowel head 101.

It shall be noted that the pivot bracket(s) 111 is positioned behind the handle bracket 104, and are separated by a linear distance 112. The placement of the pivot bracket 111 behind the handle bracket 104 insures that upon rotation of the actuator handle 103 in a downward direction, the trowel head 101 will rotate upwardly, and vice versa. However, it shall be noted that the pivot bracket(s) 111 may be positioned in front of the handle bracket 104 such that the rotation of the trowel head 101 is opposite of the desired rotation when the pivot(s) 111 bracket is behind the handle bracket 104.

The pivot rod(s) 108 attaches to the pivot bracket(s) 111 and the pivot rod point 103B by a bend 108' in the pivot rod 108.

Located at a top end of the elongated handle 102 is a grip 112, which is grabbed by a second hand 132 of the end user 130. In using the invention 100, the end user 130 shall move the trowel head 101 across the ground 140 in a laminar movement. During this movement of the trowel head 101, the end user shall rotate the actuator handle 103 thereby changing the angle 106 to insure that the trowel head 101 is level across the ground 140.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A hand trowel operable from an upright position comprising:

a trowel head attached to an elongated handle, which includes an actuator handle to rotate the trowel head with respect to the elongated handle;

wherein an end user grabs both the elongated handle and the actuator handle in order to move the trowel head across a surface;

wherein at least one pivot rod attaches between the actuator handle and the trowel head and upon rotation of the actuator handle shall rotate the trowel head about the elongated handle;

wherein the actuator handle is attached onto the elongated handle at a pivot point; wherein the actuator handle can rotate about the elongated handle via the pivot point;

wherein the actuator handle attaches to the elongated handle at the pivot point, and is further defined by a "U"-shaped bracket that includes a handle bar at an end of the "U"-shaped bracket;

wherein the pivot rod attaches onto the "U"-shaped bracket at a pivot rot point;

wherein the elongated handle includes a pivot rod guide at a predetermined point; wherein the pivot rod guide extends out from a side of the elongated handle and includes a hole through which the pivot rod passes.

2. The hand trowel as described in claim 1 wherein at least one handle bracket extend from a top surface of the trowel head; wherein the handle bracket attaches the elongated handle onto the trowel head via nut and bolt combos; wherein the trowel head can rotate with respect to the elongated handle.

3. The hand trowel as described in claim 1 wherein the pivot rod extends down to an engages a top surface of the trowel head at pivot bracket.

4. The hand trowel as described in claim 3 wherein the pivot bracket is positioned behind a handle bracket, and is separated by a linear distance.

5. The hand trowel as described in claim 4 wherein the pivot rot attached to the pivot bracket and a pivot rot point by a bend in the pivot rod.

6. The hand trowel as described in claim 1 wherein a grip is located at a top end of the elongated handle.

7. A hand trowel operable from an upright position comprising:

a trowel head attached to an elongated handle of an undefined length, which includes an actuator handle to rotate the trowel head with respect to the elongated handle;

wherein an end user grabs both the elongated handle and the actuator handle in order to move the trowel head across a surface while said end user is an upright position;

wherein at least on pivot rod attached between the actuator handle and the trowel head and upon rotation of the actuator handle shall rotate the trowel head about the elongated handle;

wherein the pivot rod attaches onto the actuator handle at a pivot rod point;

wherein at least one handle bracket extends from a top surface of the trowel head; wherein the handle bracket attaches the elongated handle on to the trowel head via nut and bolt combos; wherein the trowel head can rotate with respect to the elongated handle;

wherein the actuator handle is attached onto the elongated handle at a pivot point; wherein the actuator handle can rotate about the elongated handle via the pivot point;

wherein the actuator handle attaches to the elongated handle at the pivot point, and is further defined by a "U"-shaped bracket that includes a handle bar at an end of the "U"-shaped bracket;

wherein the elongated handle includes a pivot rod guide at a predetermined point; wherein the pivot rod guide extends out from a side of the elongated handle and includes a hole through which the pivot rod passes.

8. The hand trowel as described in claim 7 wherein the pivot rod extends down to and engages the top surface of the trowel head at pivot bracket.

9. The hand trowel as described in claim 8 wherein the pivot bracket is positioned behind the handle bracket, and is separated by a linear distance.

10. The hand trowel as described in claim 9 wherein the pivot rod attaches to the pivot bracket and a pivot rod point by a bend in the pivot rod.

11. The hand trowel as described in claim 10 wherein a grip is located at a top end of the elongated handle.

* * * * *